US006508892B2

(12) United States Patent
Hatano et al.

(10) Patent No.: US 6,508,892 B2
(45) Date of Patent: Jan. 21, 2003

(54) FE-NI ALLOY SHADOW MASK BLANK WITH EXCELLENT ETCH PERFORATION PROPERTIES AND METHOD FOR MANUFACTURING THE SAME

(75) Inventors: Takaaki Hatano, Samukawa-machi (JP); Yoshihisa Kita, Samukawa-machi (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 0 days.

(21) Appl. No.: 09/833,862

(22) Filed: Apr. 12, 2001

(65) Prior Publication Data

US 2001/0047839 A1 Dec. 6, 2001

(30) Foreign Application Priority Data

Apr. 19, 2000 (JP) ..... 2000-117788

(51) Int. Cl.[7] ..... C22C 38/08; C22F 1/10

(52) U.S. Cl. ..... 148/336; 148/621; 148/651; 420/94

(58) Field of Search ..... 148/336, 621, 148/651; 420/94

(56) References Cited

U.S. PATENT DOCUMENTS 5,391,241 A * 2/1995 Watanabe et al. ..... 148/336
5,637,161 A * 6/1997 Inoue et al. ..... 148/621
5,997,807 A * 12/1999 Kuboi ..... 420/94

* cited by examiner

*Primary Examiner*—Deborah Yee
(74) *Attorney, Agent, or Firm*—Drinker Biddle & Reath LLP

(57) ABSTRACT

A shadow mask blank of Fe—Ni alloy which exhibits excellent uniformity of diameter of apertures formed by perforation with etching for the passage of electron beams, consisting of 34–38% Ni, 0.05–0.5% Mn, 4–20 ppm S, and the balance Fe and no more than specified limits of C, Si, Al, and P, with MnS inclusions 50–1,000 nm in diameter dispersed at the density of at least 1,500/mm$^2$ or simply with etched holes 0.5–10 $\mu$m in diameter emerging at the density of at least 2,000/mm$^2$ when the blank is immersed in a 3% nitric acid-ethyl alcohol solution at 20° C. for 30 seconds. A method of manufacturing the blank comprises hot rolling of a slab of the Fe—Ni alloy, cooling, recrystallization annealing, cold rolling, etc. under controlled conditions: e.g., hot rolling the slab at 950–1,250° C. to 2–6 mm thick, cooling the stock in the range of 900–700° C. at the rate of 0.5° C./second, continuously passing the stock through a heating furnace at 850–1,100° C. for recrystallization annealing to adjust the mean diameter of the recrystallized grains to 5–30 $\mu$m, and performing the cold rolling before the final recrystallization annealing at a reduction ratio of 50–85% and the final cold rolling at a reduction ratio of 10–40%.

7 Claims, 4 Drawing Sheets

Normal aperture

Abnormal aperture

50 $\mu$m

FE-NI ALLOY SHADOW MASK BLANK WITH EXCELLENT ETCH PERFORATION PROPERTIES AND METHOD FOR MANUFACTURING THE SAME

BACKGROUND OF THE INVENTION

This invention relates to a Fe—Ni alloy blank for use in making a shadow mask by fine etching, and more specifically to a Fe—Ni alloy shadow mask blank which, when perforated by fine etching to form apertures through which electron beams pass, can improve the unevenness of aperture diameters due to the presence of irregular apertures and can provide electron beam apertures of uniform diameter and also relates to a shadow mask blank which has been formed with apertures for the passage of electron beams having improved unevenness of aperture diameters due to the presence of irregular apertures. The invention further relates to a method for manufacturing a Fe—Ni alloy blank with such properties.

In the following description the concentrations of alloy components are given on the basis of mass proportions (%=mass percentage; ppm=mass proportion).

As material of shadow masks for color picture tubes, mild steel has been commonly used. The mild steel, however, presents a problem. Continuous use of a color picture tube increases the temperature of its shadow mask due to irradiation with electron beams. Consequent thermal expansion of the mask gradually brings the points of the screen that the electron beams strike through the mask out of register with the phosphor dots of the screen, causing color misregister or mismatching. The temperature rise of the shadow mask results from the fact that when a television is turned on, only less than one-third of the total amount of the electron beams passes the apertures of the shadow mask, the remainder of the electron beams striking the mask itself. More recently, therefore, a Fe—Ni alloy of low thermal expansion coefficient known as "36 (iron-36% nickel) alloy" has come into use in the art of shadow masks for color picture tubes because of its merit in preventing color mismatching.

For the manufacture of a Fe—Ni alloy blank for shadow mask, a Fe—Ni alloy of a desired composition is melt-refined, for example, by vacuum melting in a vacuum induction melting (VIM) furnace or by secondary refining in a ladle furnace (LF). The molten metal is cast into an ingot, which in turn is forged or rolled by a blooming mill to a slab. The slab is hot rolled, descaled to remove oxide from the surface, repeatedly cold rolled and annealed for recrystallization, and, after the last recrystallization annealing, the rolled slab is finished by final cold rolling to a sheet of desired thickness in the range of 0.05 to 0.3 mm. The finally cold rolled sheet is slitted into blanks of desired width as shadow mask blanks. The blanks are degreased, coated with photoresist on both sides for patterning, exposed to light and developed to form a pattern, perforated by etching, and then cut to individual flat mask blanks. The flat mask blanks are annealed in a non-oxidizing atmosphere to impart press workability. (In the preannealing process this annealing is done on the finally cold rolled stock prior to etching.) The blanks are spherically pressed to the form of masks. Lastly, the spherically shaped masks are degreased, annealed in water vapor or combustion gas atmosphere to form a black oxide film on the mask surface. In this way shadow masks are manufactured.

For the purposes of this invention, the blanks to be etched for perforation after the final cold rolling for the passage of electron beams are collectively called shadow mask blanks. The term also encompasses the blanks, including flat masks, that have been perforated for the passage of electron beams and are yet to be press formed, as shadow mask blanks that have been formed with apertures for the passage of electron beams.

These shadow mask blanks are usually formed with apertures for the passage of electron beams by the well-known etching technique using aqueous ferric chloride. For the etching, photolithography is applied, and resist masks are formed on both sides of a blank, e.g., the mask on one side having a number of round openings 80 $\mu$m in diameter and the corresponding points of the mask on the other side having round openings 180 $\mu$m in diameter, and then aqueous solution of ferric chloride is sprayed over the both sides.

The etching provides the shadow mask blank a multiplicity of tiny apertures in a close arrangement. However, localized variation of etching conditions and other factors can result in unevenness of aperture diameters. If the unevenness is excessive, the shadow mask incorporated into a color picture tube can cause color mismatching and make the product defective. This unevenness of aperture diameters has hitherto been an important cost-raising factor as it decreases the yield in etch-perforation of shadow mask blanks for the passage of electron beams.

Various attempts have heretofore been made to control the unevenness of aperture diameters. From the material viewpoint, for example, Japanese Patent Application Kokai Nos. 5-86441 and 10-111614 propose precluding the unevenness through the control of the texture. They intend to secure the uniformity of etching by the texture control.

Our intensive research has, however, revealed that there is a phenomenon of unevenness of aperture diameter that cannot be coped with by the techniques of the prior art. FIG. 1 shows scanning electron micrographs (SEMs) of a "normal aperture" formed by etching for the passage of electron beam and an "abnormal aperture" newly found to be a cause of unevenness of aperture diameters. (The shapes of the apertures formed upon etching of only one side were comparatively observed.) The abnormal aperture is characterized by rough wall surface compared with the normal aperture. The profile of the aperture is fringed and blurred with unusual etching, the diameter tending to be larger than the target value. The characteristic configuration of the abnormal aperture varies in degree with etching and other conditions; sometimes the surrounding wall is not roughened or the fringe or blur is not clearly observed. The unevenness of the aperture diameters with the formation of abnormal apertures has not been precluded by the prior art.

OBJECT OF THE INVENTION

This invention is aimed at providing a shadow mask blank of Fe—Ni alloy which, in perforation by etching to form apertures for the passage of electron beams, will not have unevenness in the diameters of the apertures due to the formation of abnormal apertures, even if the etching conditions are locally varied, and is also aimed at providing a method of manufacturing the blank.

SUMMARY OF THE INVENTION

We have made intensive study on the problems of the prior art from an entirely new, unique viewpoint and have found that, with a shadow mask blank of Fe—Ni alloy which contains many minute inclusions, the perforation by etching scarcely causes the unevenness of aperture diameter due to the formation of abnormal apertures. Of the minute inclusions, particularly fine MnS has been found effective in controlling the unevenness of aperture diameter. In this case the MnS that proves effective in restricting the unevenness of the diameter of etched apertures for electron-beam passage is in the form of particles from 50 to 1,000 nm in diameter. The restricting effect was shown when the density (which means abundance, that is probability or frequency of existence) of MnS particles exceeded 1,500/mm$^2$. For an elliptical, bar-like, or needle shape in the purposes of this invention, as shown in FIG. 2, the diameter of MnS particle is represented by the mean value of the shorter axis L1 and the longer axis L2.

Although the detailed mechanism by which MnS controls the unevenness of the diameter of etched apertures for the passage of electron beams is not yet clarified, it is presumed to be as follows:

A rolled blank of Fe—Ni alloy according to this invention is usually etched to be a shadow mask, using an aqueous solution of ferric chloride. For that purpose a resist film is applied to the blank to cover the portions not to be perforated, so that only the portions to be perforated are exposed to the aqueous ferric chloride. If minute MnS particles are present in the portions to be perforated, they act as starting points of corrosion, accelerating the etching of the base metal. If no MnS is present in any of the portions to be perforated, all the portions are similarly etched, resulting in no unevenness of aperture diameter. In actual production on an industrial scale, however, difficulties are involved in reducing MnS and other inclusions to zero; in some portions to be perforated there are MnS particles that serve as corrosion-starting points with a certain probability. The portions to be perforated that have such corrosion-starting points initiate etching faster than the neighboring portions free from the corrosion-starting points, producing apertures with larger diameters. Since the portions to be perforated that have the starting points begin etching before the neighboring portions that do not have the starting points, the portions with the starting points electrochemically act as anodes, while the portions without the starting points act as cathodes. In this case the difference between the rates of corrosion becomes more pronounced and the difference between the diameters of etched apertures is greater too. If the blank contains minute MnS particles at a level beyond a certain density, the MnS particles are uniformly present in all the portions to be perforated, precluding any unevenness of aperture diameter.

With the blank which can form the "abnormal apertures" as termed under this invention for the passage of electron beams, the uniformity of MnS throughout the material is lost because the MnS particles that serve as the starting points of corrosion are present at a level only below a certain density. With such a material, most of the portions to be perforated contain an average level of MnS, but there are (1) portions to be perforated that do not contain MnS; (2) portions that contain much MnS; and (3) portions in which the distribution of MnS is uneven. The portions to be perforated that contain MnS at levels different from the average differ in the etching rate, due to different degree of MnS contribution to etching, from the portions that contain MnS at the average level.

Consequently, abnormally corroded apertures characterized by their surrounding walls, aperture contours, aperture diameters, etc. are detected by observation under electron microscope. The abnormal apertures can be evaluated as a measure of unevenness of aperture diameters.

Thus, contrary to the established concept of the prior art, this invention intends to positively introduce minute MnS particles at the density greater than a certain level into a Fe—Ni alloy base so as to eliminate or decrease the unevenness of diameters of etched apertures for the passage of electron beams. With this in view we have studied the means of introducing minute MnS into a Fe—Ni alloy. As a result, it has now been found that mere adjustments of Mn and S concentrations are not satisfactory; rather, in a process for hot rolling a Fe—Ni alloy slab, repeating cold rolling and recrystallization annealing, and finally cold rolling the resulting sheet to a desired thickness, it is necessary to optimize the thermal hysteresis of the material in the hot rolling and recrystallization annealing. This is because the solubility product ([%Mn]×[%S] where [Mn]: solid soluted Mn and [S]: solid soluted S) sharply decreases as the temperature drops in the temperature range from 600 to 1,200° C. over which the Fe—Ni alloy is heat treated. On the higher temperature side MnS dissolves in the Fe—Ni alloy (hereinafter called "solid solution or dissolution") and on the lower temperature side MnS forms (hereinafter called "precipitation"). We have accumulated fundamental data on the solid solution/precipitation behavior of MnS in Fe—Ni alloys and have made extensive considerations. As a result, it has now been found that in the case of a Fe—Ni alloy with a composition in conformity with this invention it is possible to set a temperature around 900° C. as a boundary and deem the range of temperatures above the boundary as the MnS solid solution temperature region and the range of temperatures below the boundary as the MnS precipitation temperature range.

For commercial production of a Fe—Ni alloy containing a desired proportion of minute MnS, it is necessary to inspect the MnS contained in the product at the site of manufacture for the purpose of the quality control of the product. The inspection of MnS particles ranging in diameter from 50 to 1,000 nm can be done using a transmission electron microscope. The method is cumbersome and not appropriate as an on-site inspection method, however. We thus have studied on the way of simply and conveniently determining the density of minute MnS particles. As a consequence, it has now come clear that when the surface of a Fe—Ni alloy specimen is mirror polished and then immersed in a 3% nitric acid-ethyl alcohol solution at 20° C. for 30 seconds to produce etched holes, a good correlationship is obtained between the density of MnS determined under a transmission electron microscope and the density of the etched holes from 0.5 to 10 $\mu$m in diameter among the etched holes produced. The 3% nitric acid-ethyl alcohol solution is herein a mixture of 100 ml of ethanol having a purity of 99.5 vol % (JIS K8101 Special Grade) and 3 ml of nitric acid with a concentration of 60% (JIS K8541). FIG. 3 shows the results.

Observation of MnS under a transmission electron microscope is performed, over an area of 0.01 mm$^2$, as follows:

(1) The surface of a specimen is electropolished at a constant potential. The electropolishing consists in polishing the specimen at the thickness corresponding to 5 coulomb/cm$^2$ in a 10% acetylacetone–1% tetramethylammonium chloride-methyl alcohol at a potential of +100 mV vs SCE. This electropolishing dissolves only the Fe—Ni base surface, leaving undissolved inclusions protruding from the polished surface.

(2) When acetyl cellulose is applied to the electropolished surface and the resulting film is peeled off, the inclusions protruded from the polished surface now stick to the back side of the film.

(3) Carbon is evaporation-deposited onto the inclusions-sticking side of the acetyl cellulose film, and then the film is immersed in methyl acetate to dissolve the acetyl cellulose.

(4) The carbon film holding the inclusions is observed under a transmission electron microscope to inspect the states of the inclusions. At the same time, the compositions of the inclusions are identified by EDS and electron beam diffraction.

On the other hand, for the observation of the etched holes after the immersion in a 3% nitric acid-ethyl alcohol solution, an optical microscope was used and a dark field image of the corroded surface was photographed at 400 magnifications. From this photograph the number of etched holes with diameters between 0.5 and 10 $\mu$m was counted. For the measurements of the etched holes an image analyzer was used to measure each surface area of 0.2 $mm^2$. The etched holes were substantially spherically shaped, and their diameters were measured in the direction parallel to the rolling direction.

From FIG. 3 it is obvious that the number of MnS particles counted under a transmission electron microscope as the density of 1,500/$mm^2$ corresponds to 2,000/$mm^2$ in terms of the etched holes formed by the immersion in a 3% nitric acid-ethyl alcohol solution.

In view of the foregoing findings and considerations, this invention provides a shadow mask blank of Fe—Ni alloy which exhibits excellent uniformity of diameter of apertures for the passage of electron beams when the apertures are formed by perforation with etching, consisting of, on the basis of mass percentage (%), from 34 to 38% Ni, from 0.05 to 0.5% Mn, from 4 to 20 ppm (mass proportion) S, and the balance Fe and unavoidable impurities or accompanying elements, provided that C is no more than 0.10%, Si is no more than 0.30%, Al is no more than 0.30%, and P is no more than 0.005%, wherein MnS inclusions from 50 to 1,000 nm in diameter are dispersed at the density of at least 1,500/$mm^2$. Alternatively, it may conveniently be defined as a shadow mask blank of Fe—Ni alloy which exhibits excellent uniformity of diameter of apertures for the passage of electron beams when the apertures are formed by perforation with etching, consisting of, on the basis of mass percentage (%), from 34 to 38% Ni, from 0.05 to 0.5% Mn, from 4 to 20 ppm (mass proportion) S, and the balance Fe and unavoidable impurities or accompanying elements, provided that C is no more than 0.10%, Si is no more than 0.30%, Al is no more than 0.3%, and P is no more than 0.005%, wherein etched holes from 0.5 to 10 $\mu$m in diameter appear at the density of at least 2,000/$mm^2$ when the blank surface is mirror polished and immersed in a 3% nitric acid-ethyl alcohol solution at 20° C. for 30 seconds.

This invention also provides a method of manufacturing a Fe—Ni alloy blank which comprises hot rolling a slab of Fe—Ni alloy consisting of, on the basis of mass percentage (%), from 34 to 38% Ni, from 0.05 to 0.5% Mn, from 4 to 20 ppm (mass proportion) S, and the balance Fe and unavoidable impurities or accompanying elements, provided that C is no more than 0.10%, Si is no more than 0.30%, Al is no more than 0.3%, and P is no more than 0.005%; repeating cold rolling and recrystallization annealing, and, after final recrystallization annealing, finally cold rolling the rolled slab to a blank from 0.05 to 0.3 mm thick, through any of the process steps A to D mentioned below, wherein the blank either contains MnS inclusions from 50 to 1,000 nm in diameter dispersed at the density of at least 1,500/$mm^2$ or has etched holes from 0.5 to 10 $\mu$m in diameter appearing at the density of at least 2,000/$mm^2$ when the blank surface is mirror polished and immersed in a 3% nitric acid-ethyl alcohol solution at 20° C. for 30 seconds.

(Process Step A)

(1) In the course of hot rolling, working the slab in the temperature range of 950 to 1,250° C. until the thickness is between 2 and 6 mm and, after the hot rolling, cooling the resulting rolled slab from 900° C. down to 700° C. at an average cooling rate set to 0.5° C./second or below;

(2) In all of the recrystallization annealing runs, adjusting the temperature to 850 to 1,100° C. and continuously passing the rolled material through a heating furnace filled with hydrogen or a hydrogen-containing inert gas, thereby adjusting the mean diameter of the recrystallized grains to 5 to 30 $\mu$m; and (3) Setting the reduction ratio of the cold rolling before the final recrystallization annealing to 50 to 85%, and setting the reduction ratio of the final cold rolling to 10 to 40%.

(Process Step B)

(1) In the hot rolling, working the slab in the temperature range of 950 to 1,250° C. to a thickness of 2 to 6 mm;

(2) In the intermediate recrystallization annealing before the final recrystallization annealing, annealing the rolled material in a heating furnace filled with hydrogen or a hydrogen-containing inert gas to obtain recrystallized grains having a mean diameter of 5 to 30 $\mu$m;

(3) In the final recrystallization annealing, holding the rolled slab in a heating furnace filled with hydrogen or a hydrogen-containing inert gas at an internal temperature of 650 to 850° C. for 3 to 20 hours, thereby adjusting the mean diameter of the recrystallized grains to 5 to 30 $\mu$m; and (4) Setting the reduction ratio of the cold rolling before the final recrystallization annealing to 50 to 85% and setting the reduction ratio of the final cold rolling to 10 to 40%.

(Process Step C)

(1) In the course of hot rolling, working the slab in the temperature range of 950 to 1,250° C. until the thickness is between 2 and 6 mm;

(2) In the intermediate recrystallization annealing before the final recrystallization annealing, holding the rolled material in a heating furnace filled with hydrogen or a hydrogen-containing inert gas at an internal temperature of 650 to 850° C. for 3 to 20 hours to obtain recrystallized grains having a mean diameter of 5 to 30 $\mu$m;

(3) In all the recrystallization annealing runs after the intermediate recrystallization annealing (2) above, passing the rolled material continuously through a heating furnace filled with hydrogen or a hydrogen-containing inert gas at an internal temperature of 850 to 1,100° C., thereby adjusting the mean diameter of the recrystallized grains to 5 to 30 $\mu$m; and (4) Setting the reduction ratio of the cold rolling before the final recrystallization annealing to 50 to 85% and setting the reduction ratio of the final cold rolling to 10 to 40%.

(Process Step D)

(1) In the course of hot rolling, working the slab in the temperature range of 950 to 1,250° C. until the thickness is between 2 and 6 mm;

(2) In all of the recrystallization annealing runs, annealing the rolled material in a heating furnace filled with hydrogen or a hydrogen-containing inert gas, thereby obtaining recrystallized grains from 5 to 30 $\mu$m in mean diameter;

(3) Setting the reduction ratio of the cold rolling before the final recrystallization annealing to 50 to 85%, and setting the reduction ratio of the final cold rolling to 10 to 40%; and (4) Performing, after the final cold rolling, annealing not involving recrystallization in a temperature range of 500 to 800° C.

This invention further provides a shadow mask blank the above-defined Fe—Ni alloy having apertures for the passage of electron beams formed by etching with reduced unevenness of aperture diameter due to the presence of abnormal apertures, wherein MnS inclusions from 50 to 1,000 nm in diameter are dispersed at the density of at least 1,500/mm$^2$.

DETAILED DESCRIPTION OF THE INVENTION

Figure 1:
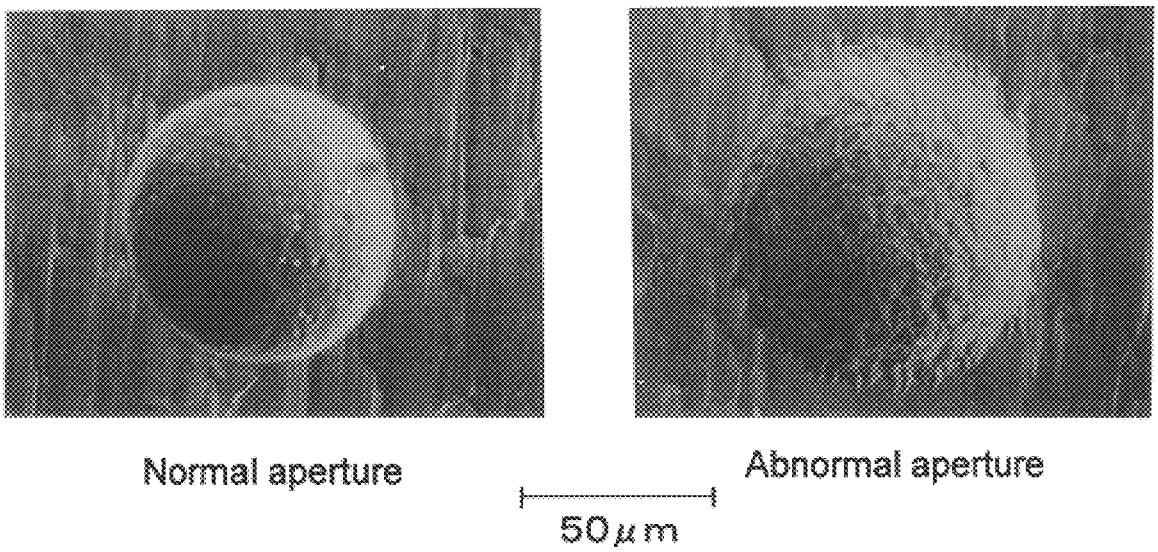
FIG. 1 shows scanning electron micrographs (SEMs) of a typical "normal aperture" formed by etching to form apertures for the passage of electron beams and of an "abnormal aperture" newly found as a cause of the unevenness of aperture diameters (comparative observation of shapes of apertures when formed by etching of only one side of a blank)
Figure 2A:
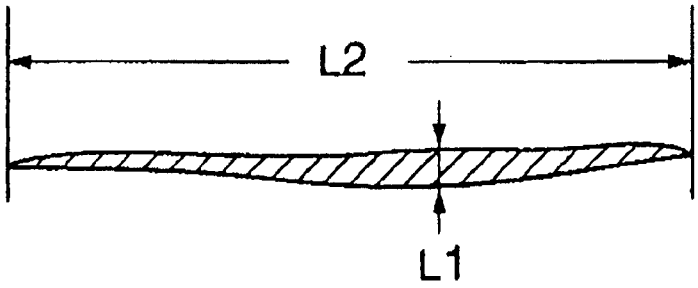
FIG. 2 shows in cross section MnS particles which are elliptical (FIG. 2*a*), bar-like (FIG. 2*b*), and needle shaped (FIG. 2*c*), with respect to the particle short axis L1 and long axis L2.
Figure 2B:
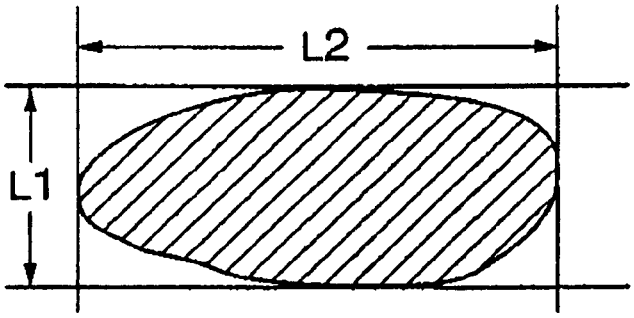
Figure 2C:
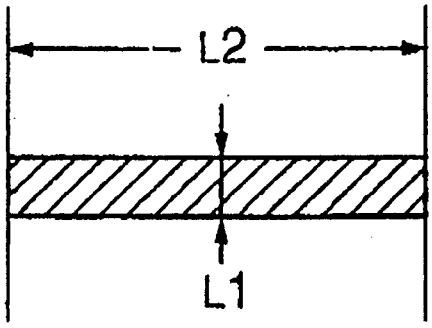

Under this invention the Ni content in the Fe—Ni alloy blank is specified to be from 34 to 38%. If the Ni content is outside this range, a too high coefficient of thermal expansion makes it unusable as a shadow mask blank. As for the C, Si, Al, and P contained as impurities or accompanying elements in the Fe—Ni alloy, upper limits of 0.10%, 0.30%, 0.30%, and 0.005% are put, respectively, because any element exceeding the concentration impairs the etching perforation properties of the blank and makes it unusable as a shadow mask blank.

As stated earlier, for the manufacture of a shadow mask blank of Fe—Ni alloy, a Fe—Ni alloy of a desired composition is melt-refined, e.g., by vacuum melting in a vacuum induction melting (VIM) furnace or by secondary refining in a ladle furnace (LF). The melt is cast into an ingot and then forged or rolled by a blooming mill into a slab. The slab is then hot rolled, descaled for the removal of oxide scale from the surface, and is subjected to repeated cold rolling and recrystallization annealing. After the final recrystallization annealing, it is finally cold rolled to an ultimate sheet thickness of 0.05 to 0.3 mm as desired. The finally cold rolled sheet is slitted to blanks in strips of desired width as shadow mask blanks. The blank are degreased, coated with photoresist on both sides, exposed to light for patterning, developed, and is perforated with an etching solution, and then the perforated blanks are cut into individual flat masks. The flat masks are annealed in a non-oxidizing atmosphere to impart press workability. (In a preannealing method this annealing is conducted on the finally cold rolled sheet before being etched.) Each flat mask is spherically shaped by pressing to the form of a mask. Lastly, the spherically shaped mask is degreased, annealed in water vapor or a combustion gas atmosphere to form a black oxide film on the mask surface. In this way a shadow mask is made.

The properties of a Fe—Ni alloy blank of this invention and the method of manufacturing the same will now be described in detail.

(1) Number of MnS Particles

MnS particles serve as starting points of corrosion and, when they occur at a given density throughout the blank material, they effectively restrict the unwanted scatter of diameters of apertures for the passage of electron beams in the blank perforated by etching. The favorable effect is achieved only with MnS particles from 50 to 1,000 nm in diameter and when they are present at the density of no less than 1,500 particles/mm$^2$. Particles less than 50 nm in diameter are too small to act as starting points of corrosion. Conversely particles larger than 1,000 nm apparently exhibit adverse effects because of too strong corroding action. In order to realize an adequate density to show the unevenness-controlling effect, it is necessary that there are more than 1,500 particles/mm$^2$. It is usually desirable that the particles are dispersed at the density of 2,000 to 7,000 particles/mm$^2$. The term "number of MnS particles" as used herein means the number counted by the afore-described procedure using a transmission electron microscope.

(2) Number of Etched Holes

Figure 3:
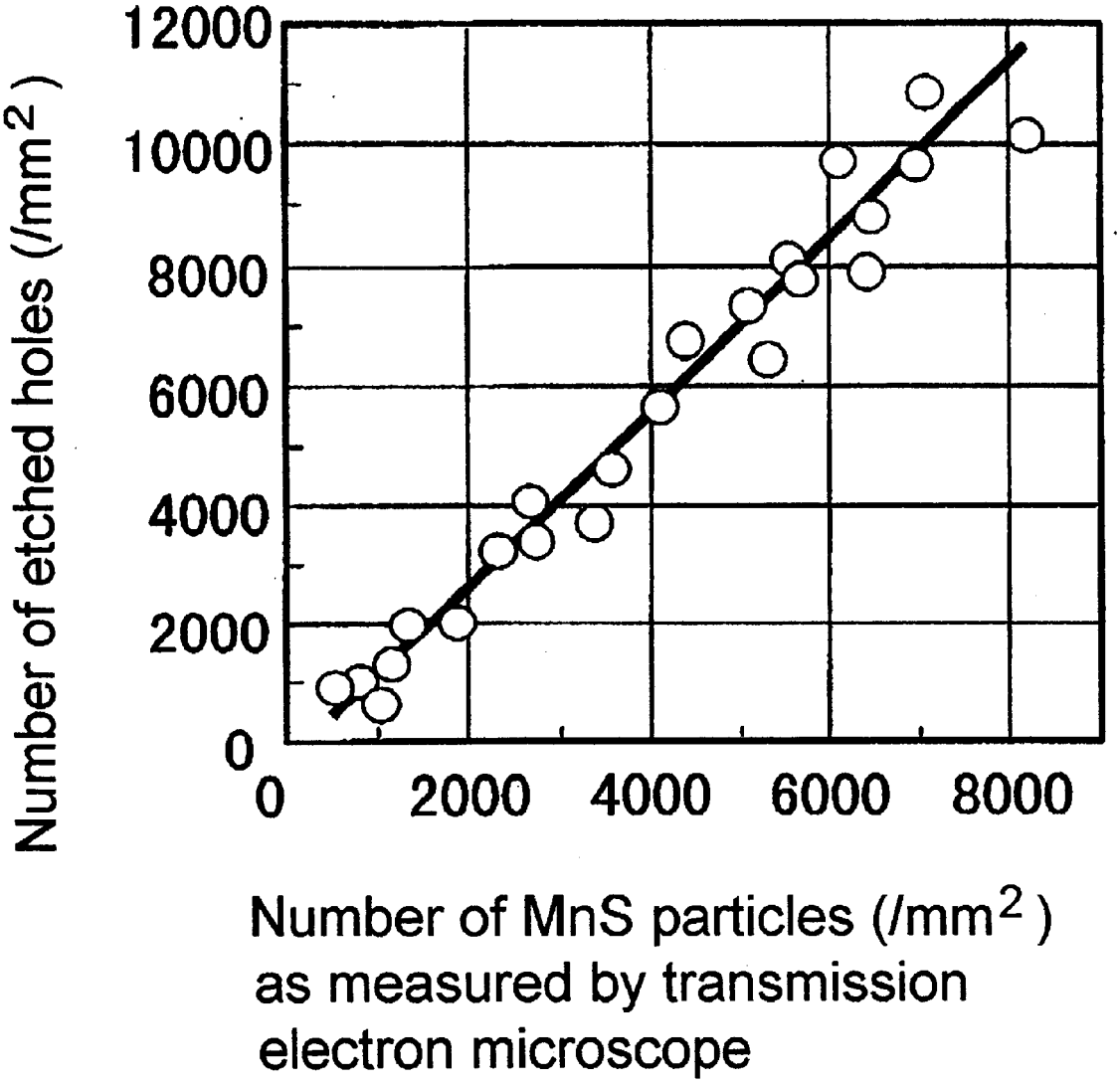
FIG. 3 is a graph showing the correlation between the numbers of MnS particles counted under a transmission electron microscope and the numbers of etched holes formed by the immersion in a 3% nitric acid-ethyl alcohol solution.

As noted already, the number of etched holes from 0.5 to 10 $\mu$m in diameter that are formed by the immersion of a Fe—Ni alloy surface in a 3% nitric acid-ethyl alcohol solution shows a good correlation to the number of MnS particles with diameters of 50 to 1,000 nm measured under a transmission electron microscope. Hence this is a very effective method of simply determining the number of MnS particles. As FIG. 3 indicates, the case in which MnS particles from 50 to 1,000 nm are present at the density of at least 1,500/mm$^2$ corresponds to the case where there are at least 2,000/mm$^2$ etched holes from 0.5 to 10 $\mu$m in diameter. From 2,000 to 7,000 MnS particles/mm$^2$ correspond to from 2,500 to 10,000 etched holes/mm$^2$.

(3) Mn and S Concentrations

Mn and S are essential elements for the precipitation of MnS. In order that MnS particles from 50 to 1,000 nm in diameter be present at the density of at least 2,000/mm$^2$ in a Fe—Ni alloy, it is necessary that the Mn and S concentrations in the alloy are no less than 0.05% and no less than 4 ppm, respectively. When the Mn or S is below the concentration range, it is not possible to obtain a desired number of MnS particles even though the manufacturing process is adjusted. If the S concentration exceeds 20 ppm, many coarse MnS inclusions more than 10 $\mu$m long are formed. If the portions where there are such coarse inclusions are perforated by etching to form apertures for the passage of electron beams, precisely round apertures are not obtained. The S concentration in excess of 20 ppm presents an additional problem of lowered hot workability. On the other hand, if the Mn concentration is greater than 0.5% the blank material is so hard that it is difficult to work. For these reasons the Mn concentration is specified in the range from 0.05 to 0.5% and the S concentration in the range from 4 to 20 ppm.

(4) Manufacturing Method

The Fe—Ni alloy blank for use in fabricating shadow masks is usually 0.05 to 0.3 mm thick. A hot rolled sheet from 2 to 6 mm thick is repeatedly subjected to cold rolling and recrystallization annealing and, after the final recrystallization annealing, the work is finally finished by cold rolling to a thickness of 0.05 to 0.3 mm. Of the series of process steps, those which contribute to the formation of MnS are hot rolling and annealing.

1) Hot Rolling

Hot rolling of a Fe—Ni alloy is usually carried out at 950 to 1,250° C. In this temperature range MnS dissolves in the base metal. Thus, after the hot rolling, the sheet is slowly cooled and MnS is allowed to precipitate during the course of cooling. Since the precipitation of MnS proceeds at temperatures below 900° C. and the rate of MnS precipitation decreases as the temperature drops below 700° C., from 900 down to 700° C. is appropriate as a temperature range for slow cooling. If the mean cooling rate at that time is set to below 0.5° C./second, at least 2,000 MnS particles from 50 to 1,000 nm in diameter can be precipitated per square millimeter.

2) Recrystallization Annealing

There are two different procedures; one using a continuous annealing line and carried out under high-temperature short-time conditions, and the other using a batch annealing furnace under low-temperature long-time conditions. In either case the heating furnace should be filled with hydrogen gas or hydrogen-containing inert gas so as to prevent surface oxidation of the material. The size of the recrystallized grains after annealing must be adjusted so that the mean diameter of the grains is between 5 and 30 μm. The term "mean diameter of grains" as used herein means the grain size of a cross section parallel to the rolling direction as measured generally in conformity with the cutting method set forth in the Japanese Industrial Standards JIS H0501. For the visualization of the structure, the surface to be observed was mirror finished by mechanical polishing and was immersed in an aqueous solution of nitric acid and acetic acid. When the grain size after the final annealing is larger than 30 μm, the surrounding wall surface of the apertures perforated by etching is roughened and an additional problem of lowered etching rate is posed. Also when the grain size after the intermediate annealing exceeds 30 μm, the structure after the final annealing is heterogeneous (large and small grains are present as mixed), the surrounding wall surface of the electron beam-passage apertures are roughened and the etching rate is non-uniform. If the grain size is smaller than 5 μm the grain size in the material is difficult to control uniformly. Among other problems is lowered workability in the ensuing cold rolling step.

2)-a) Continuous Annealing

Under the high-temperature short time annealing conditions it is difficult to cause positive precipitation of MnS. However, the solid solution of MnS can be prevented by restricting the highest achievable temperature of annealed material to or below 900° C. (the boundary temperature between MnS solid solution and precipitation). On a continuous annealing line the material temperature does not reach the atmosphere temperature inside the furnace, and the attainable material temperature varies with both the atmosphere temperature inside the furnace and the rate at which the material is passed through the furnace. Thus, the attainable material temperature should be evaluated in terms of the actually measured temperature of the material rather than the atmosphere temperature inside the furnace. Exact measurement of the material temperature is extremely difficult, however. In view of this, we investigated the relation between the atmosphere temperature inside the furnace and the number of MnS particles from 50 to 1,000 nm in diameter that are left after the annealing under conditions that the mean grain size after the annealing is adjusted to 30 μm. As a result it was found that if the furnace atmosphere temperature is adjusted to 1,100° C. or below, the number of MnS particles remain practically unchanged before and after the annealing. It was learned from this result that, when the grain size after the annealing is adjusted to 5 to 30 μm, the attainable material temperature does not exceed 900° C. if the atmosphere temperature inside the furnace is set to 1,100° C. or below. On the other hand, when the furnace temperature was below 850° C., the rate at which the material was passed through the furnace to obtain recrystallized grains 5 μm or more in diameter was slowed down, seriously decreasing the production efficiency.

From the foregoing it was found that if the atmosphere temperature inside the furnace is set to the range of 850 to 1,100° C. when annealing a Fe—Ni alloy using a continuous annealing line, recrystallized grains with mean diameters in the range of 5 to 30 μm can be obtained without losing the MnS particles from 50 to 1,000 nm in diameter and decreasing the production efficiency.

2)-b) Batch Annealing

Low-temperature long-time annealing permits MnS precipitation along with the recrystallization of the material. For this annealing a material as coiled is introduced into a heating furnace, the temperature inside the furnace is increased to and held at a predetermined level, and then the furnace is cooled and the coil is taken out. For the annealing under the invention it is appropriate to hold the material inside the furnace at a temperature between 650 and 850° C. for 3 to 15 hours. If the furnace temperature is above 850° C. the crystal grains after the annealing become larger than 30 μm in diameter, whereas if the temperature is below 650° C. recrystallized grains 5 μm or more in diameter are not obtained. A holding time longer than 10 hours increases the manufacturing cost, while a holding time shorter than 3 hours causes a problem of uneven temperature throughout the coil, with the of localized scatter of grain diameters.

3) Annealing not Accompanied with Recrystallization

The material is annealed under conditions that do not allow the progress of recrystallization, and MnS is precipitated.

This annealing may be carried out using either a continuous annealing line or a batch annealing furnace. The latter achieves a greater MnS precipitation effect because it anneals for longer time. For the precipitation of MnS it is suitable to set the annealing temperature to the range of 500 to 800° C. The heating time in this case is decided within the range which does not cause the recrystallization of the material. This treatment is effectively applied to the material after its final cold rolling.

4) Combination of Heat Treatments

In order to manufacture a Fe—Ni alloy blank containing MnS as desired, the afore-described heat treatments may be combined in the following way:

a) Hot rolling for MnS precipitation, and carrying out all the ensuing runs of recrystallization annealing using a continuous annealing line under conditions not causing solid solution of MnS. (Process step A)

b) Conducting hot rolling and an intermediate recrystallization annealing under suitably chosen conditions, and performing the final recrystallization annealing by batch operation to precipitate MnS. (Process step B)

c) Following hot rolling (and recrystallization annealing) performed under suitably chosen conditions, carrying out recrystallization annealing batchwise under conditions to precipitate MnS. Conducting ensuing recrystallization annealing using a continuous annealing line under conditions not causing solid solution of MnS. (Process C)

d) Performing hot rolling and recrystallization annealing under suitably chosen conditions and, after the final rolling, doing annealing that does not involve recrystallization and thereby effecting MnS precipitation. (Process step D)

The process summarized above is one designed with the presumption that recrystallization annealing is done twice between the hot rolling and the final cold rolling. With the similar concept varied combinations of annealing steps may be designed when the recrystallization annealing is done once or more than twice.

Other conceivable approaches include, instead of MnS precipitation by slow cooling after hot rolling, causing the MnS precipitation by the annealing of 2)-b) or 3) done subsequently to the hot rolling.

5) Cold Rolling Reduction Ratio

While cold rolling does not contribute to the MnS solid solution/precipitation, its reduction ratio is restricted by the following reasons. The term "rolling reduction ratio (R)" as used herein is defined by an equation $R\ (\%)=(t_0-t)/t_0\times 100$, in which $t_0$ is the thickness of the stock before being rolled and t is its thickness after the rolling.

a) Reduction Ratio of Cold Rolling Before the Final Recrystallization Annealing

When the reduction ratio is greater than 85% the (200) texture develops remarkably, impairing the exact roundness of the electron beam-passage apertures that are formed by etching. Conversely when the reduction ratio is less than 50% the degree of development of the (200) texture in the product is too low and the etching rate lowers.

b) Reduction Ratio of the Final Cold Rolling

If the reduction ratio exceeds 40% the rolled texture develops extremely and the etching rate for the perforation by etching to form apertures for the passage of electron beams drops. If the reduction ratio is below 10%, in the annealing to impart the workability immediately before pressing unrecrystallized structure remains and affects the press workability of the product in the annealing to impart the workability immediately before pressing. Hence the reduction ratio is restricted to the range of 10 to 40%.

The required manufacturing conditions described above may be summarized as follows:

(Process Step A)

(1) In the course of hot rolling, working the slab in the temperature range of 950 to 1,250° C. until the thickness is between 2 and 6 mm and, after the hot rolling, cooling the resulting rolled slab from 900°C. down to 700° C. at an average cooling rate set to 0.5° C./second or below;

(2) In all of the recrystallization annealing runs, adjusting the temperature to 850 to 1,100° C. and continuously passing the rolled material through a heating furnace filled with hydrogen or a hydrogen-containing inert gas, thereby adjusting the mean diameter of the recrystallized grains to 5 to 30 μm; and (3) Setting the reduction ratio of the cold rolling before the final recrystallization annealing to 50 to 85%, and setting the reduction ratio of the final cold rolling to 10 to 40%.

(Process Step B)

(1) In the hot rolling, working the slab in the temperature range of 950 to 1,250° C. to a thickness of 2 to 6 mm;

(2) In the intermediate recrystallization annealing before the final recrystallization annealing, annealing the rolled material in a heating furnace filled with hydrogen or a hydrogen-containing inert gas to obtain recrystallized grains having a mean diameter of 5 to 30 μm;

(3) In the final recrystallization annealing, holding the rolled material in a heating furnace filled with hydrogen or a hydrogen-containing inert gas at an internal temperature of 650 to 850° C. for 3 to 20 hours, thereby adjusting the mean diameter of the recrystallized grains to 5 to 30 μm; and (4) Setting the reduction ratio of the cold rolling before the final recrystallization annealing to 50 to 85% and setting the reduction ratio of the final cold rolling to 10 to 40%.

(Process Step C)

(1) In the course of hot rolling, working the slab in the temperature range of 950 to 1,250° C. until the thickness is between 2 and 6 mm;

(2) In the intermediate recrystallization annealing before the final recrystallization annealing, holding the rolled material in a heating furnace filled with hydrogen or a hydrogen-containing inert gas at an internal temperature of 650 to 850° C. for 3 to 20 hours to obtain recrystallized grains having a mean diameter of 5 to 30 μm;

(3) In all the recrystallization annealing runs after the intermediate recrystallization annealing (2) above, passing the rolled material continuously through a heating furnace filled with hydrogen or a hydrogen-containing inert gas at an internal temperature of 850 to 1,100° C., thereby adjusting the mean diameter of the recrystallized grains to 5 to 30 μm; and (4) Setting the reduction ratio of the cold rolling before the final recrystallization annealing to 50 to 85% and setting the reduction ratio of the final cold rolling to 10 to 40%.

(Process Step D)

(1) In the course of hot rolling, working the slab in the temperature range of 950 to 1,250° C. until the thickness is between 2 and 6 mm;

(2) In all of the recrystallization annealing runs, annealing the rolled material in a heating furnace filled with hydrogen or a hydrogen-containing inert gas, thereby obtaining recrystallized grains from 5 to 30 μm in mean diameter;

(3) Setting the reduction ratio of the cold rolling before the final recrystallization annealing to 50 to 85%, and setting the reduction ratio of the final cold rolling to 10 to 40%; and (4) Performing, after the final cold rolling, annealing not involving recrystallization in a temperature range of 500 to 800° C.

By way of the hot and cold rolling steps satisfying the foregoing requirements, a Fe—Ni alloy blank is obtained which when perforated by etching to form apertures for the passage of electron beams, does not show unevenness of aperture diameter due to the presence of abnormal apertures, despite localized variations of the etching conditions.

By etching the above blank to form the apertures for the passage of electron beams, there is provided a shadow mask blank formed with electron beam-passage apertures with reduced unevenness of aperture diameters due to the presence of abnormal apertures.

EXAMPLES

Example 1 and Comparative Example 1

An ingot in which the concentrations of Ni and impurities (accompanying elements) were adjusted to the ranges of: Ni, 35.8–36.5%; Si, 0.02–0.03%; Al, 0.01–0.02%; C, 10–30 ppm; O, 20–100 ppm; P, 20–30 ppm, N, 10–30 ppm; and Cr, 200–300 ppm, and further the concentrations of Mn and S were adjusted to the ranges of 0.2–0.3% and 5–10 ppm, respectively, was made by vacuum melting, and the ingot was forged to a slab with a 200 mm thickness. The slab was heated to 1,100° C. and hot rolled to a thickness of 3 mm.

After the removal of oxide scale from the surface, the resulting sheet was further worked to 0.6 mm thick (rolling I) and subjected to recrystallization annealing (annealing I). It was further cold rolled with a reduction ratio of 75% to 0.15 mm thick (rolling II) and was annealed for recrystallization (annealing II). Lastly, it was cold rolled with a reduction ratio of 33% to 0.1 mm thick (final cold rolling, or rolling III). In this series of steps, the conditions of cooling after the hot rolling and recrystallization annealing were variously changed. Also, some materials, after rolling to the thickness of 0.1 mm (final cold rolling) were subjected to the annealing that did not accompanied with recrystallization.

With the materials that had gone through the hot rolling step, rolling steps I–III, and annealing steps I–II, the densities of etched holes formed by the immersion in a 3% nitric acid-ethyl alcohol solution were measured. Details of the measuring method used and the correlations between the measured values and the numbers of MnS particles are as was clarified above. With each material measurements were made at 10 different points (for a measurement area of 0.2 $mm^2$ each), and the mean value was calculated.

Also, with the materials (corresponding to the products) that had gone through the final step (after rolling III as the final cold rolling or, if done, after the annealing that did not accompanied with recrystallization), resist masks were formed having a multiplicity of round openings 80 $\mu$m in diameter formed on one side surface and having a multiplicity of round openings 180 $\mu$m in diameter on the opposite side surface. An aqueous solution of ferric chloride was then sprayed over the masks for etching to form apertures for the passage of electron beams. On the side where 80 $\mu$m-dia. apertures had been made, the diameters of 100 apertures (maximum diameter value of each aperture) thus formed were measured.

Table 1 gives the Mn and S concentrations in the materials, the rates of cooling after the hot rolling in the working step, annealing conditions and grain sizes, and the densities of the etched holes formed in the materials after the final working (rolling III) by the immersion in a nitric acid-ethyl alcohol solution and the distributions of diameters of the apertures for the passage of electron beams. According to the results of measurements of the aperture diameters, the electron beam-passage apertures in each material were classified by diameters into three groups; those smaller than 78 $\mu$m, those in the range of 78 to 82 $\mu$m, and those larger than 82 $\mu$m. The numbers of the apertures in the three groups are given (the total number being 100).

Figure 4:
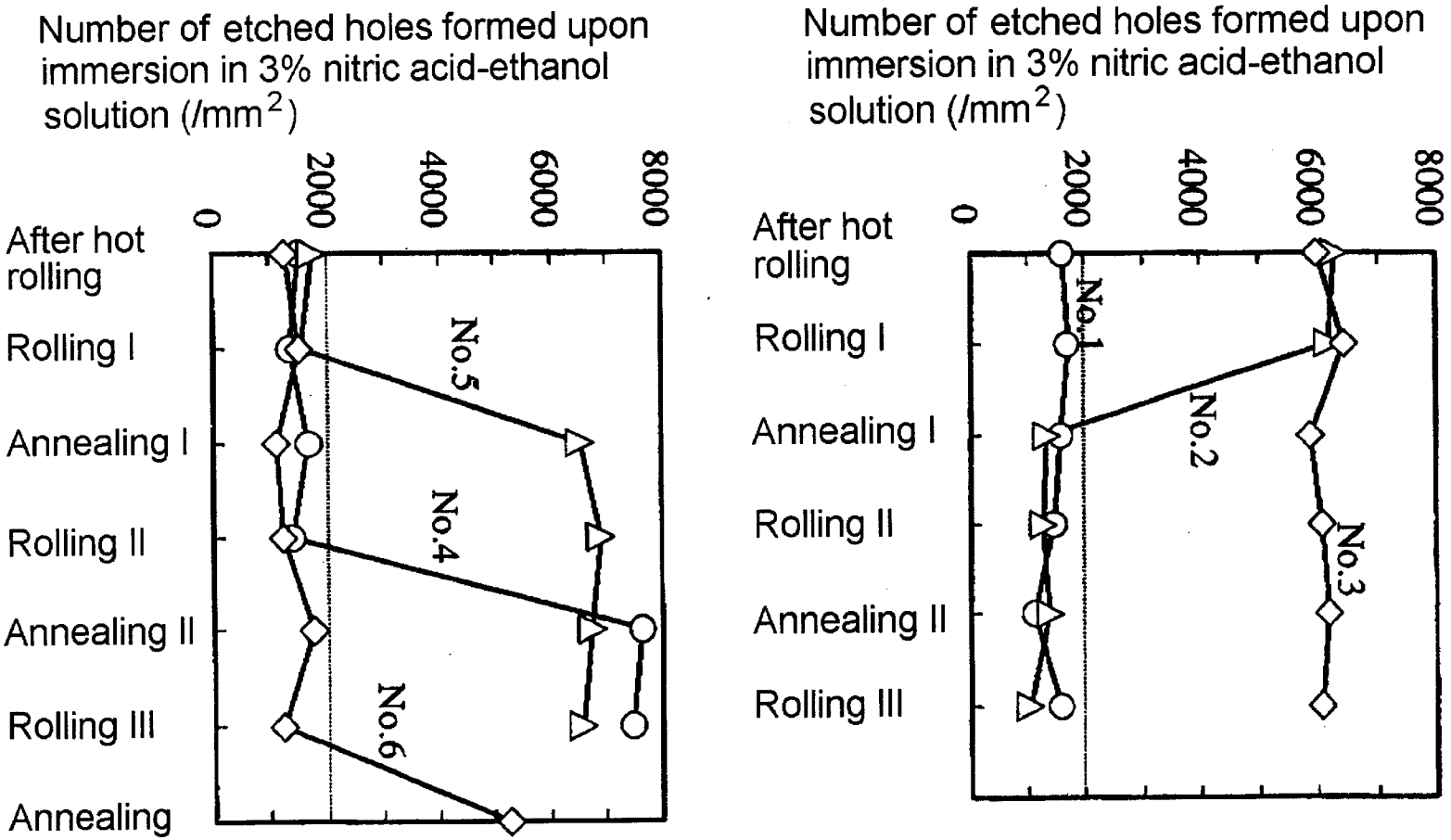
FIG. 4 graphically represents the results of measurements of the densities of etched holes formed by the immersion in a nitric acid-ethyl alcohol solution of the materials after the conclusion of the process steps in connection with Example 1.

FIG. 4 shows the results of measurements of the densities of etched holes formed by the immersion in a nitric acid-ethyl alcohol solution of the materials after the conclusion of the process steps.

Nos. 1, 4, 5, and 6 were cooled faster than the remainder after the hot rolling, and the numbers of etched holes counted after the hot rolling were small because of the solid solution of MnS.

Of the four, No. 1 that had gone through the all runs of recrystallization annealing using a continuous annealing line under high-temperature short-time conditions retains the number of etched holes at a low level to the last, without any increase in the number of etched holes upon recrystallization annealing, failing to reach the target number of 2,000 holes/$mm^2$.

No. 4 was subjected to the final recrystallization annealing (annealing II) using a batch furnace under low-temperature long-time conditions, when the MnS precipitation progressed with a substantial increase in the number of etched holes.

No. 5 similarly showed a considerable increase in the number of etched holes when the first recrystallization annealing (annealing I) was done using a batch furnace. For the subsequent recrystallization annealing a continuous annealing line was used, but since the operation was performed under conditions in the ranges specified under this invention, the solid solution of MnS did not proceed and the state where etched holes were abundant was maintained.

No. 6 showed fewer than 2,000 etched holes/$mm^2$ after the final rolling because all the runs of recrystallization annealing were done using a continuous annealing line. But, the addition of low-temperature annealing increased the number of etched holes beyond the 2,000/$mm^2$ level.

On the other hand, Nos. 2 and 3 that had been slowly cooled after the hot rolling had abundant etched holes after the hot rolling, because of MnS precipitation during the course of slow cooling.

No. 3 that had been subsequently recrystallization annealed using a continuous annealing line under conditions within the ranges of this invention retained the same density of etched holes after the hot rolling until after the final rolling.

No. 2, however, had fewer than 2,000 etched holes/$mm^2$ due to solid solution of MnS during the annealing, because the first recrystallization annealing was conducted on a continuous annealing line at a furnace temperature in excess of 1,100° C.

With the materials (product materials) after the final rolling (rolling III), Table 1 indicates the relations between the numbers of etched holes after the immersion in a nitric acid-ethanol solution and the diameters of the apertures subsequently formed by etching for the passage of electron beams. Nos. 3 to 6 which had more than 2,000 etched holes/$mm^2$ each, showed the diameters of their electron beam-passage apertures in the range of 80±2 $\mu$m. Nos. 1 and 2 which had fewer than 2,000 etched holes/$mm^2$ showed some passage apertures with diameters outside the range of 80±2 $\mu$m.

TABLE 1

Compositions of test specimens, thermal hysteresis, numbers of etched holes formed after working, and diameters of the apertures formed after working for the passage of electron beams

| | Composition | | Hot rolling | Annealing I | | | |
|---|---|---|---|---|---|---|---|
| No. | Mn (mass %) | S (mass ppm) | Cooling rate at 900–700° C. | Method | Furnace temperature ° C. | In-furnace time | Grain size, μm |
| 1 | 0.25 | 7 | >1 (water-cooled) | Continuous | 1,000 | 40 sec. | 20 |
| 2 | 0.30 | 6 | 0.2 | Continuous | 1,150 | 35 sec. | 35 |
| 3 | 0.28 | 10 | 0.3 | Continuous | 1,000 | 40 sec. | 20 |
| 4 | 0.22 | 8 | >1 (water-cooled) | Continuous | 1,150 | 35 sec. | 35 |
| 5 | 0.25 | 7 | >1 (water-cooled) | Batch | 750 | 8 hrs. | 25 |
| 6 | 0.27 | 6 | >1 (water-cooled) | Continuous | 1,200 | 25 sec. | 25 |

| | Annealing II | | | | | No./mm$^2$ of etched | Diameter of apertures (apertures) for electron beam passage | | |
|---|---|---|---|---|---|---|---|---|---|
| No. | Method | Furnace temperature, ° C. | In-furnace time | Grain size, μm | Annealing after final rolling | holes after immersion in nitric acid-ethanol | <78 μm | 80 μm ± 2 | >82 μm |
| 1 | Continuous | 1,000 | 12 sec. | 15 | No | 1,550 | 2 | 92 | 6 |
| 2 | Continuous | 1,000 | 12 sec. | 15 | No | 1,040 | 1 | 90 | 9 |
| 3 | Continuous | 1,000 | 12 sec. | 15 | No | 6,040 | 0 | 100 | 0 |
| 4 | Continuous | 700 | 6 hrs. | 15 | No | 7,470 | 0 | 100 | 0 |
| 5 | Continuous | 1,050 | 10 sec. | 15 | No | 6,590 | 0 | 100 | 0 |
| 6 | Continuous | 1,100 | 10 sec. | 20 | 600° C. × 8 hrs. | 5,280 | 0 | 100 | 0 |

Example 2 and Comparative Example 2

Hot Rolling Conditions

To investigate appropriate conditions for hot rolling, 200 mm-thick slabs of the same composition as used in Example 1 were hot rolled under varied heating conditions to a thickness of 3 mm, cooled at varied rates, and then descaled for the removal of oxide film. These materials were immersed in a 3% nitric acid-ethyl alcohol solution in the same way as in Example 1, and the densities of the resulting etched holes were measured. The results are given in Table 2. It will be seen that the slower the cooling rate in the range from 900 down to 700° C. the larger the number of etched holes tends to produce. The slab heating temperature (hot rolling temperature) was found to have no influence upon the number of etched holes, but when the hot rolling temperature was 900° C. a Ni segregate in the ingot structure remained in the hot rolled material.

TABLE 2

Influences of hot rolling conditions upon the number of etched holes formed after the immersion in a 3% nitric acid-ethyl alcohol solution

| No. | Slab heating Temperature, ° C. | Average cooling rate in the 900–700° C. range, ° C./sec. | Number of etched holes/mm$^2$ | Remarks |
|---|---|---|---|---|
| 1 | 1,150 | >1 (water-cooled) | 1,440 | |
| 2 | 1,150 | 0.5 | 6,240 | |
| 3 | 1,150 | 0.1 | 6,930 | |
| 4 | 1,150 | 0.05 | 7,380 | |
| 5 | 1,150 | 0.01 | 8,020 | |
| 7 | 1,200 | 0.1 | 6,840 | |

TABLE 2-continued

Influences of hot rolling conditions upon the number of etched holes formed after the immersion in a 3% nitric acid-ethyl alcohol solution

| No. | Slab heating Temperature, ° C. | Average cooling rate in the 900–700° C. range, ° C./sec. | Number of etched holes/mm$^2$ | Remarks |
|---|---|---|---|---|
| 8 | 1,100 | 0.1 | 7,010 | |
| 9 | 1,000 | 0.1 | 6,960 | |
| 10 | 900 | 0.1 | 6,790 | Residual Ni segregation |

Example 3 and Comparative Example 3

Recrystallization Annealing on Continuous Annealing Line

Conditions to avoid the solid solution of MnS in recrystallization annealing that is performed using a continuous annealing line were studied. Materials were annealed under varied conditions of furnace temperature and furnace retention time and then immersed in a 3% nitric acid-ethyl alcohol solution following the same procedure as described in Example 1, and the densities of of etched holes were measured. In this test, 200 mm-thick slabs of the same compositions as in Example 1 were hot rolled, descaled for the removal of oxide scale, cold rolled (rolling I) to a thickness of 0.6 mm, and then annealed (annealing I), all under the same conditions as used for No. 3 in Example 1. The results are summarized in Table 3.

By way of reference, there are also shown in Table 3 the estimated maximum attainable temperatures of the materials in the furnace calculated from their heat balances. No. 1 represents the data before annealing.

When the grain size is adjusted to 30 μm (the maximum grain size specified under the invention), setting the temperature inside the furnace to below 1,100° C. gives etched holes in numbers at the same level as those before the annealing (Nos. 8 to 12).

When the furnace temperature is set to 1,100° C., adjusting the grain size to below 30 μm gives the same level of numbers of etched holes as before the annealing (Nos. 3 to 6).

In brief, recrystallization annealing performed by setting the furnace temperature to 1,100° C. or below and under conditions that finish the grain size to 30 μm or below prevents the solid solution of the MnS that has been present since before the annealing.

On the other hand, when the furnace temperature is below 850° C., very long retention time is required for continuous annealing and the production efficiency is very poor (No. 13), even though the grain size is adjusted to 5 μm (the minimum grain size specified under the invention).

TABLE 3

Influences of annealing conditions upon etched holes formed after the immersion in a 3% nitric acid-ethyl alcohol solution

| No. | Furnace temperature, ° C. | Retention time inside furnace, sec. | Grain size after annealing, μm | Number of etched holes/mm² | Estimated maximum attainable temp., ° C. |
|---|---|---|---|---|---|
| 1 | Before annealing | — | — | 6,390 | — |
| 2 | 1,100 | 85 | 35 | 1,760 | 940 |
| 3 | 1,100 | 70 | 30 | 5,920 | 890 |
| 4 | 1,100 | 44 | 20 | 6,200 | 850 |
| 5 | 1,100 | 23 | 10 | 6,610 | 810 |
| 6 | 1,100 | 18 | 5 | 6,240 | 780 |
| 7 | 1,150 | 61 | 30 | 1,640 | 970 |
| 8 | 1,050 | 80 | 30 | 6,520 | 880 |
| 9 | 1,000 | 95 | 30 | 6,640 | 880 |
| 10 | 950 | 120 | 30 | 6,310 | 870 |
| 11 | 900 | 154 | 30 | 6,460 | 870 |
| 12 | 850 | 89 | 5 | 6,390 | 770 |
| 13 | 830 | 342 | 5 | 6,650 | 760 |

Example 4 and Comparative Example 4

Recrystallization Annealing in a Batch Furnace

In effecting MnS precipitation by recrystallization annealing using a batch furnace, conditions (furnace temperature and retention time) for adjusting the grain size within the range of 5 to 30 μm were studied. For this purpose materials were annealed under varied conditions, and the densities of etched holes formed by the immersion of the materials in a 3% nitric acid-ethyl alcohol solution in the same way as described in Example 1 were determined. Also the resulting structures were inspected in the aforementioned manner. resulting was conducted with the materials in coiled forms. The observation of the structure of each material were done in two points of each coil, one on the outer surface and the other inside of the coil. In the test, 200 mm-thick slabs of the same compositions as in Example 1 were hot rolled, descaled for the removal of oxide scale, cold rolled (rolling I) to a thickness of 0.6 mm, and then subjected to the recrystallization annealing (annealing I) under the same conditions as used for No. 4 of Example 1. The results are shown in Table 4. No. 1 represents the data before the annealing.

When the annealing temperature was below 650° C. (No. 2) there were remained part of the material which was not recrystallized. When the annealing time was short of 3 hours (No. 3) the grain size was varied according to the location in the coil. In both cases the numbers of etched holes increased but the increments were small.

TABLE 4

Influences of annealing conditions upon the grain sizes and the numbers of etched holes formed by the immersion in a 3% nitric acid-ethyl alcohol solution

| No. | Furnace temperature, ° C. | Retention time in furnace, hr | Grain size after annealing, μm: Outer coil surface | Grain size after annealing, μm: Inside of coil | Number of etched holes/mm² |
|---|---|---|---|---|---|
| 1 | Before annealing | — | — | — | 1,420 |
| 2 | 630 | 4 | 5 | Not Recrystalized | 3,290 |
| 3 | 700 | 2 | 15 | 5 | 2,930 |
| 4 | 700 | 4 | 15 | 15 | 6,290 |
| 5 | 700 | 7 | 20 | 20 | 7,460 |
| 6 | 700 | 14 | 25 | 25 | 8,320 |
| 7 | 750 | 7 | 20 | 20 | 7,510 |
| 8 | 800 | 7 | 25 | 25 | 5,730 |
| 9 | 850 | 7 | 30 | 30 | 5,360 |

Example 5

Annealing not Accompanied with Recrystallization

With regard to the method of effecting MnS precipitation by carrying out an annealing not accompanied with recrystallization after the final rolling (rolling III), the relations between the annealing conditions (annealing method, temperature inside the annealing furnace, and retention time in the furnace) and the number of etched holes formed upon immersion in a 3% nitric acid-ethyl alcohol solution were studied. The method of measuring the etched was the same as used in Example 1. The resulting structures were also observed in the same way. In this test, 200 mm-thick slabs of the same compositions as in Example 1 were cold rolled (final cold rolling, rolling III) to a thickness of 0.1 mm under the same conditions as for No. 6 in Example 1, and annealed. The results are given in Table 5. A comparison between batch and continuous annealing operations shows that batch annealing produces increased numbers of etched holes.

TABLE 5

Influences of annealing conditions upon the grain size after the annealing and upon the numbers of etched holes after the immersion in a 3% nitric acid-ethyl alcohol solution

| No. | Annealing method | Furnace temperature, ° C. | Retention time in furnace | Number of etched holes/mm² |
|---|---|---|---|---|
| 1 | — | Before annealing | — | 1,460 |
| 2 | Batch furnace | 400 | 4 hrs. | 4,560 |
| 3 | Batch furnace | 500 | 4 hrs. | 6,430 |
| 4 | Batch furnace | 600 | 4 hrs. | 7,650 |
| 5 | Continuous line | 700 | 90 sec. | 2,860 |
| 6 | Continuous line | 800 | 40 sec. | 3,110 |

Example 6 and Comparative Example 6

Component Concentrations

From Fe—Ni alloys of varied Ni concentrations and impurity (accompanying element) concentrations, ingots of varied Mn and S concentrations were made. The ingots were rolled by a blooming mill to 200 mm-thick slabs. The slabs were worked (final cold rolling, rolling III) under the same conditions as for No. 3 in Example 1 to a thickness of 0.1 mm. The materials were immersed in a 3% nitric acid-ethyl alcohol solution and the numbers of the resulting etched holes were measured.

The samples were perforated by etching to form apertures for the passage of electron beams, and their diameters (the maximum diameters of the individual apertures) were measured. The measuring method used was the same as in Example 1. Regardless of the Ni concentration or impurity concentrations, more than 2,000 etched holes were obtained per square millimeter when the Mn concentration was no less than 0.05% and the S concentration was no less than 4 ppm, and the diameters of the electron beam-passage apertures were within the range of 80±2 $\mu$m. No. 15 represents the case in which the Mn concentration was 0.03% and No. 16 represents the case in which the S concentration was 2 ppm.

TABLE 6

Influences of Mn and S concentrations upon the numbers of etched holes and the diameters of apertures for the passage of electron beams

| | Composition | | | | | | | | | | Number | Diameter of electron beam-passage apertures | | |
|---|---|---|---|---|---|---|---|---|---|---|---|---|---|---|
| No. | Ni (mass %) | Si (mass ppm) | Al (mass ppm) | C (mass ppm) | O (mass ppm) | P (mass ppm) | N (mass ppm) | Cr (mass ppm) | Mn (mass %) | S (mass ppm) | of etched holes/mm$^2$ | <78 $\mu$m | 80 ± 2 $\mu$m | >82 $\mu$m |
| 1 | 35.8 | 240 | 120 | 23 | 35 | 20 | 23 | 220 | 0.05 | 7 | 5970 | 0 | 100 | 0 |
| 2 | 36.1 | 320 | 180 | 20 | 29 | 30 | 16 | 330 | 0.24 | 8 | 6780 | 0 | 100 | 0 |
| 3 | 35.7 | 190 | 190 | 12 | 42 | 30 | 12 | 180 | 0.38 | 8 | 6380 | 0 | 100 | 0 |
| 4 | 35.9 | 250 | 140 | 30 | 34 | 20 | 19 | 230 | 0.46 | 5 | 5830 | 0 | 100 | 0 |
| 5 | 36.2 | 330 | 200 | 27 | 45 | 20 | 17 | 170 | 0.25 | 4 | 3460 | 0 | 100 | 0 |
| 6 | 36.1 | 200 | 190 | 26 | 31 | 30 | 10 | 120 | 0.23 | 12 | 8080 | 0 | 100 | 0 |
| 7 | 36.7 | 310 | 320 | 15 | 17 | 40 | 20 | 220 | 0.21 | 18 | 9340 | 0 | 100 | 0 |
| 8 | 36.2 | 65 | 7 | 25 | 57 | 20 | 8 | 70 | 0.24 | 7 | 6710 | 0 | 100 | 0 |
| 9 | 36.8 | 78 | 6 | 33 | 52 | 40 | 10 | 68 | 0.25 | 8 | 6600 | 0 | 100 | 0 |
| 10 | 32.2 | 77 | 5 | 27 | 63 | 50 | 7 | 63 | 0.23 | 9 | 6190 | 0 | 100 | 0 |
| 11 | 37.0 | 61 | 150 | 37 | 55 | 20 | 6 | 59 | 0.24 | 7 | 6680 | 0 | 100 | 0 |
| 12 | 36.1 | 1070 | 190 | 14 | 30 | 40 | 20 | 230 | 0.22 | 12 | 7890 | 0 | 100 | 0 |
| 13 | 36.0 | 240 | 2090 | 28 | 35 | 30 | 14 | 220 | 0.24 | 7 | 6590 | 0 | 100 | 0 |
| 14 | 36.1 | 190 | 190 | 80 | 50 | 50 | 40 | 230 | 0.26 | 11 | 7500 | 0 | 100 | 0 |
| 15 | 35.9 | 310 | 180 | 22 | 21 | 20 | 16 | 180 | 0.03 | 7 | 1580 | 2 | 93 | 5 |
| 16 | 36.3 | 310 | 200 | 13 | 42 | 30 | 15 | 170 | 0.25 | 2 | 930 | 3 | 89 | 8 |

This invention throws new light on the problem of uneven aperture diameters due to the presence of abnormal apertures that results from the perforation by etching to form apertures for the passage of electron beams. This invention has investigated on the fact that Fe—Ni alloy materials containing much minute inclusions, especially minute MnS particles, scarcely show upon etching the unevenness of aperture diameters due to the presence of abnormal apertures. As the result it has now been found for the first time in the art that the MnS particles effective for controlling the unevenness of aperture diameters are those having diameters in the range of 50 to 1,000 nm and the MnS particles manifest their controlling effect when their density is more than 1,500 particles/mm$^2$. With the Fe—Ni alloy blank according to the invention, the apertures formed by etching perforation for the passage of electron beams have microscopically uniform diameters.

This invention is effectively applicable to all the shadow mask blanks that are perforated by etching to form apertures for the passage of electron beams, even to those blanks that are not press worked after the etching but are imparted with tension to retain a flat shape. The electron beam-passage apertures need not be exactly round; this invention is applicable as well to shadow masks perforated to provide elliptical, slot-like and other beam-passage apertures. Further, the invention is applicable not only to shadow masks but also to other uses that involve fine etching such as lead frames.

What is claimed is:

1. A shadow mask blank of Fe—Ni alloy which exhibits excellent uniformity of diameter of apertures for the passage of electron beams when the apertures are formed by perforation with etching, consisting of, on the basis of mass percentage (%), from 34 to 38% Ni, from 0.05 to 0.5% Mn, from 4 to 20 ppm (mass proportion) S, and the balance Fe and unavoidable impurities or accompanying elements, provided that C is no more than 0.10%, Si is no more than 0.30%, Al is no more than 0.30%, and P is no more than 0.005%, wherein MnS inclusions from 50 to 1,000 nm in diameter are dispersed at the density of at least 1,500/mm$^2$.

2. A shadow mask blank of Fe—Ni alloy which exhibits excellent uniformity of diameter of apertures for the passage of electron beams when the apertures are formed by perforation with etching, consisting of, on the basis of mass percentage (%), from 34 to 38% Ni, from 0.05 to 0.5% Mn, from 4 to 20 ppm (mass proportion) S, and the balance Fe and unavoidable impurities or accompanying elements, provided that C is no more than 0.10%, Si is no more than 0.30%, Al is no more than 0.3%, and P is no more than 0.005%, wherein etched holes from 0.5 to 10 $\mu$m in diameter appear at the density of at least 2,000/mm$^2$ after the blank has been tested by a procedure in which the blank surface is mirror polished and immersed in a 3% nitric acid-ethyl alcohol solution at 20° C. for 30 seconds.

3. A method of manufacturing a Fe—Ni alloy blank which comprises hot rolling a slab of Fe—Ni alloy consisting of, on the basis of mass percentage (%), from 34 to 38% Ni, from 0.05 to 0.5% Mn, from 4 to 20 ppm (mass proportion) S, and the balance Fe and unavoidable impurities or accompanying elements, provided that C is no more than 0.10%, Si is no more than 0.30%, Al is no more than 0.3%, and P is no more than 0.005%; repeating cold rolling and recrystallization annealing, and, after final recrystallization annealing, finally cold rolling the stock to a sheet from 0.05 to 0.3 mm thick, through the process steps:

(1) in the course of hot rolling, working the slab in the temperature range of 950 to 1,250° C. until the thickness is between 2 and 6 mm and, after the hot rolling, cooling the resulting rolled slab from 900° C. down to 700° C. at an average cooling rate set to 0.5° C./second or below;

(2) in all of the recrystallization annealing runs, adjusting the temperature to 850 to 1,100° C. and continuously passing the rolled material through a heating furnace filled with hydrogen or a hydrogen-containing inert gas, thereby adjusting the mean diameter of the recrystallized grains to 5 to 30 μm; and (3) setting the reduction ratio of the cold rolling before the final recrystallization annealing to 50 to 85%, and setting the reduction ratio of the final cold rolling to 10 to 40%; wherein the blank either contains MnS inclusions from 50 to 1,000 nm in diameter dispersed at the density of at least 1,500/mm$^2$ or has etched holes from 0.5 to 10 μm in diameter appearing at the density of at least 2,000/mm$^2$ when the blank surface is mirror polished and immersed in a 3% nitric acid-ethyl alcohol solution at 20 C. for 30 seconds.

4. A method of manufacturing a Fe—Ni alloy blank which comprises hot rolling a slab of Fe—Ni alloy consisting of, on the basis of mass percentage (%), from 34 to 38% Ni, from 0.05 to 0.5% Mn, from 4 to 20 ppm (mass proportion) S, and the balance Fe and unavoidable impurities or accompanying elements, provided that C is no more than 0.10%, Si is no more than 0.30%, Al is no more than 0.3%, and P is no more than 0.005%; repeating cold rolling and recrystallization annealing, and, after final recrystallization annealing, finally cold rolling the stock to a sheet from 0.05 to 0.3 mm thick, through the process steps:

(1) in the course of hot rolling, working the slab in the temperature range of 950 to 1,250° C. until the thickness is between 2 and 6 mm;

(2) in the intermediate recrystallization annealing before the final recrystallization annealing, annealing the rolled material in a heating furnace filled with hydrogen or a hydrogen-containing inert gas to obtain recrystallized grains having a mean diameter of 5 to 30 μm;

(3) in the final recrystallization annealing, holding the rolled material in a heating furnace filled with hydrogen or a hydrogen-containing inert gas at an internal temperature of 650 to 850° C. for 3 to 20 hours, thereby adjusting the mean diameter of the recrystallized grains to 5 to 30 μm; and (4) setting the reduction ratio of the cold rolling before the final recrystallization annealing to 50 to 85% and setting the reduction ratio of the final cold rolling to 10 to 40%; wherein the blank either contains MnS inclusions from 50 to 1,000 nm in diameter dispersed at the density of at least 1,500/mm$^2$ or has etched holes from 0.5 to 10 μm in diameter appearing at the density of at least 2,000/mm$^2$ when the blank surface is mirror polished and immersed in a 3% nitric acid-ethyl alcohol solution at 20° C. for 30 seconds.

5. A method of manufacturing a Fe—Ni alloy blank which comprises hot rolling a slab of Fe—Ni alloy consisting of, on the basis of mass percentage (%), from 34 to 38% Ni, from 0.05 to 0.5% Mn, from 4 to 20 ppm (mass proportion) S, and the balance Fe and unavoidable impurities or accompanying elements, provided that C is no more than 0.10%, Si is no more than 0.30%, Al is no more than 0.3%, and P is no more than 0.005%; repeating cold rolling and recrystallization annealing, and, after final recrystallization annealing, finally cold rolling the stock to a sheet from 0.05 to 0.3 mm thick, through the process steps:

(1) in the course of hot rolling, working the slab in the temperature range of 950 to 1,250° C. until the thickness is between 2 and 6 mm;

(2) in the intermediate recrystallization annealing before the final recrystallization annealing, holding the rolled material in a heating furnace filled with hydrogen or a hydrogen-containing inert gas at an internal temperature of 650 to 850° C. for 3 to 20 hours to obtain recrystallized grains having a mean diameter of 5 to 30 μm;

(3) in all the recrystallization annealing runs after the intermediate recrystallization annealing (2) above, passing the rolled slab continuously through a heating furnace filled with hydrogen or a hydrogen-containing inert gas at an internal temperature of 850 to 1,100° C., thereby adjusting the mean diameter of the recrystallized grains to 5 to 30 μm; and (4) setting the reduction ratio of the cold rolling before the final recrystallization annealing to 50 to 85% and setting the reduction ratio of the final cold rolling to 10 to 40%; wherein the blank either contains MnS inclusions from 50 to 1,000 nm in diameter dispersed at the density of at least 1,500/mm$^2$ or has etched holes from 0.5 to 10 μm in diameter appearing at the density of at least 2,000/mm$^2$ when the blank surface is mirror polished and immersed in a 3% nitric acid-ethyl alcohol solution at 20° C. for 30 seconds.

6. A method of manufacturing a Fe—Ni alloy blank which comprises hot rolling a slab of Fe—Ni alloy consisting of, on the basis of mass percentage (%), from 34 to 38% Ni, from 0.05 to 0.5% Mn, from 4 to 20 ppm (mass proportion) S, and the balance Fe and unavoidable impurities or accompanying elements, provided that C is no more than 0.10%, Si is no more than 0.30%, Al is no more than 0.3%, and P is no more than 0.005%; repeating cold rolling and recrystallization annealing, and, after final recrystallization annealing, finally cold rolling the stock to a sheet from 0.05 to 0.3 mm thick, through the process steps:

(1) in the course of hot rolling, working the slab in the temperature range of 950 to 1,250° C. until the thickness is between 2 and 6 mm;

(2) in all of the recrystallization annealing runs, annealing the rolled slab in a heating furnace filled with hydrogen or a hydrogen-containing inert gas, thereby obtaining recrystallized grains from 5 to 30 μm in mean diameter;

(3) setting the reduction ratio of the cold rolling before the final recrystallization annealing to 50 to 85%, and setting the reduction ratio of the final cold rolling to 10 to 40%; and (4) performing, after the final cold rolling, annealing not accompanied with recrystallization in a temperature range of 500 to 800° C.; wherein the blank either contains MnS inclusions from 50 to 1,000 nm in diameter dispersed at the density of at least 1,500/mm$^2$ or having etched holes from 0.5 to 10 μm in diameter appearing at the density of at least 2,000/mm$^2$ when the blank surface is mirror polished and immersed in a 3% nitric acid-ethyl alcohol solution at 20° C. for 30 seconds.

7. A shadow mask blank consisting of, on the basis of mass percentage (%), from 34 to 38% Ni, from 0.05 to 0.5% Mn, from 4 to 20 ppm (mass proportion) S, and the balance Fe and unavoidable impurities or accompanying elements, provided that C is no more than 0.10%, Si is no more than 0.30%, Al is no more than 0.3%, and P is no more than 0.005%, said blank having apertures formed by etching for the passage of electron beams with reduced unevenness of aperture diameter due to the presence of abnormal apertures, wherein MnS inclusions from 50 to 1,000 nm in diameter are dispersed at the density of at least 1,500/mm$^2$.

* * * * *